US006072395A

United States Patent [19]

Vega

[11] Patent Number: 6,072,395

[45] Date of Patent: Jun. 6, 2000

[54] REMOTE CONTROLLED CLASSROOM SIGNALLING DEVICE FOR BEHAVIOR CONTROL

[76] Inventor: Mary Ellen Vega, 1235 Parker Pl., Unit 28, San Diego, Calif. 92019

[21] Appl. No.: 09/262,354

[22] Filed: Mar. 4, 1999

Related U.S. Application Data

[60] Provisional application No. 60/077,319, Mar. 9, 1999.

[51] Int. Cl.[7] ..... G08B 21/00

[52] U.S. Cl. ..... 340/573.1; 307/117; 340/309.4; 340/326; 340/332; 340/691.1; 340/566; 340/815.67; 434/237; 434/433

[58] Field of Search ..... 340/573.1, 540, 340/566, 691.1, 691.3, 693.8, 309.4, 326, 332, 815.67; 307/117; 434/237, 433

[56] References Cited

U.S. PATENT DOCUMENTS

| | | | |
|---|---|---|---|
| 2,103,447 | 12/1937 | Carl | 446/446 |
| 2,157,171 | 5/1939 | Hathaway | 246/22 |
| 2,520,445 | 5/1948 | Sponsler | 446/485 |
| 3,114,127 | 12/1963 | Ramsey | 340/906 |
| 3,600,826 | 8/1971 | Thomas | 434/237 |
| 3,636,507 | 1/1972 | Harsanyl | 340/906 |
| 4,278,966 | 7/1981 | Hemsher | 340/815.67 |
| 4,654,642 | 3/1987 | Groff | 340/573.1 |
| 5,103,204 | 4/1992 | Hartman | 340/332 |
| 5,365,219 | 11/1994 | Wong et al. | 340/573.1 |

*Primary Examiner*—Glen Swann
*Attorney, Agent, or Firm*—Robert Platt Bell

[57] ABSTRACT

A plurality of lights operated by timers and/or a radio frequency remote control device are used to direct students from one activity to another. The lights are preferably arranged in a housing to resemble a traffic signal, the housing also including electrical circuitry to actuate the lights in response to timers, the remote control device, or noise levels above a selected threshold to communicate with the students. For example, a red light could signal the class to be quiet, a yellow light could indicate it is time to prepare for the next classroom activity, and a green light indicate it is time to move on to the next activity. The invention replaces the tedium of vocally repeating classroom instructions with signaling lights controlled automatically or responsive to the remote control device.

40 Claims, 4 Drawing Sheets

REMOTE CONTROLLED CLASSROOM SIGNALLING DEVICE FOR BEHAVIOR CONTROL

CROSS-REFERENCE TO RELATED APPLICATIONS

The present invention claims priority from Provisional U.S. Patent Application Ser. No. 60/77,319, filed on Mar. 9, 1999, and incorporated herein by reference.

FIELD OF THE INVENTION

The present invention relates to the field of behavioral controls and more particularly to a method and apparatus for use in classrooms and groups, for behavior modification, classroom control, and training.

BACKGROUND OF THE INVENTION

It is desirable for an instructor to maintain order and discipline in the classroom. Far too often, a teacher must repeat phrases, class announcements and give repetitive directions. As a result, a teacher may tend to be viewed more as taskmaster and baby-sitter than as instructor and muse.

Even well-behaved and motivated, but exuberant youngsters, would benefit from a method and apparatus which minimizes repetitious instructor commands, maximizes student cooperation and trains students in the practice of orderly behavior.

In the behavioral sciences, the importance of providing feedback has been long recognized. Feedback enables a person to know whether their behavior is appropriate. Young children in particular are somewhat deficient in this area and frequently need help in anticipating what is appropriate behavior. A visual indicator providing children in a classroom setting with feedback on what behavior is appropriate and when, could be a useful tool in the classroom.

Traffic lights and controllers are well known in the art. Moreover, children are trained, at an early age, as to the meaning of the sequence of colored lights in a traffic signal; green means go, red means stop, yellow means caution. Thus, most grade-school students intuitively understand the red/yellow/green signalling of a traffic light. Ramsey, U.S. Pat. No. 3,114,127 discloses an emergency traffic light which may be operated by remote control. Toy signals can be found in Sponsler, U.S. Pat. No. 2,520,445; Hathaway, U.S. Pat. No. 2,157,171 and Carl, U.S. Pat. No. 2,103,447.

Behavioral modification devices are also known in the art. Thomas, U.S. Pat. No. 3,600,826, discloses a plurality of signalling light assemblies for behavior modification, whereby clients of a therapist are isolated at light and switch stations such that each client can signal the other by means of lights.

Groff, U.S. Pat. No. 4,654,642, incorporated herein by reference, discloses an audio noise alarm, with indicators, for classrooms. Noise levels are monitored and an alarm circuitry activated when a predetermined noise level is reached. If a second noise level above the first incident occurs, an alarm may be triggered. Although Groff provides an audio alarm, it does not appear that Groff contemplates a visual alarm (other then a LED counter output) which may be readily seen by students. Although audio alarms are useful, they may not be heard over the din of student noise. Moreover, such audio alarms are useless for deaf students.

None of these references disclose the teaching and behavior modification of groups of students by utilizing a plurality of lights (alone or in combination with sounds) under remote control.

SUMMARY OF THE INVENTION

A plurality of lights, operated remotely, are utilized to direct students from one activity to another. A preferred embodiment of the present invention provides a signalling assembly w resembling a traffic light, which includes a plurality of signalling lamps, an audio annunciator and electrical signalling circuits which function in response to a separate hand-held radio frequency or infrared remote control. The remote control could be operated by a classroom instructor, or student. Rather than repeatedly telling students to be quiet, all the instructor needs to do with the present invention is merely depress the appropriate button on the hand-held remote control for a red lamp to signal to the class to be quiet. Yellow could be designated to inform the class to prepare for the next class activity and a green lamp might direct the class to move on to the next project. The invention replaces the tedium of repeating classroom instructions, with signalling lights, under remote control.

BRIEF DESCRIPTION OF THE DRAWINGS

In order that the invention may be more readily understood, we shall describe certain embodiments of the remote controlled classroom signalling device, in terms of the accompanying drawings.

DETAILED DESCRIPTION OF THE INVENTION

Figure 1:
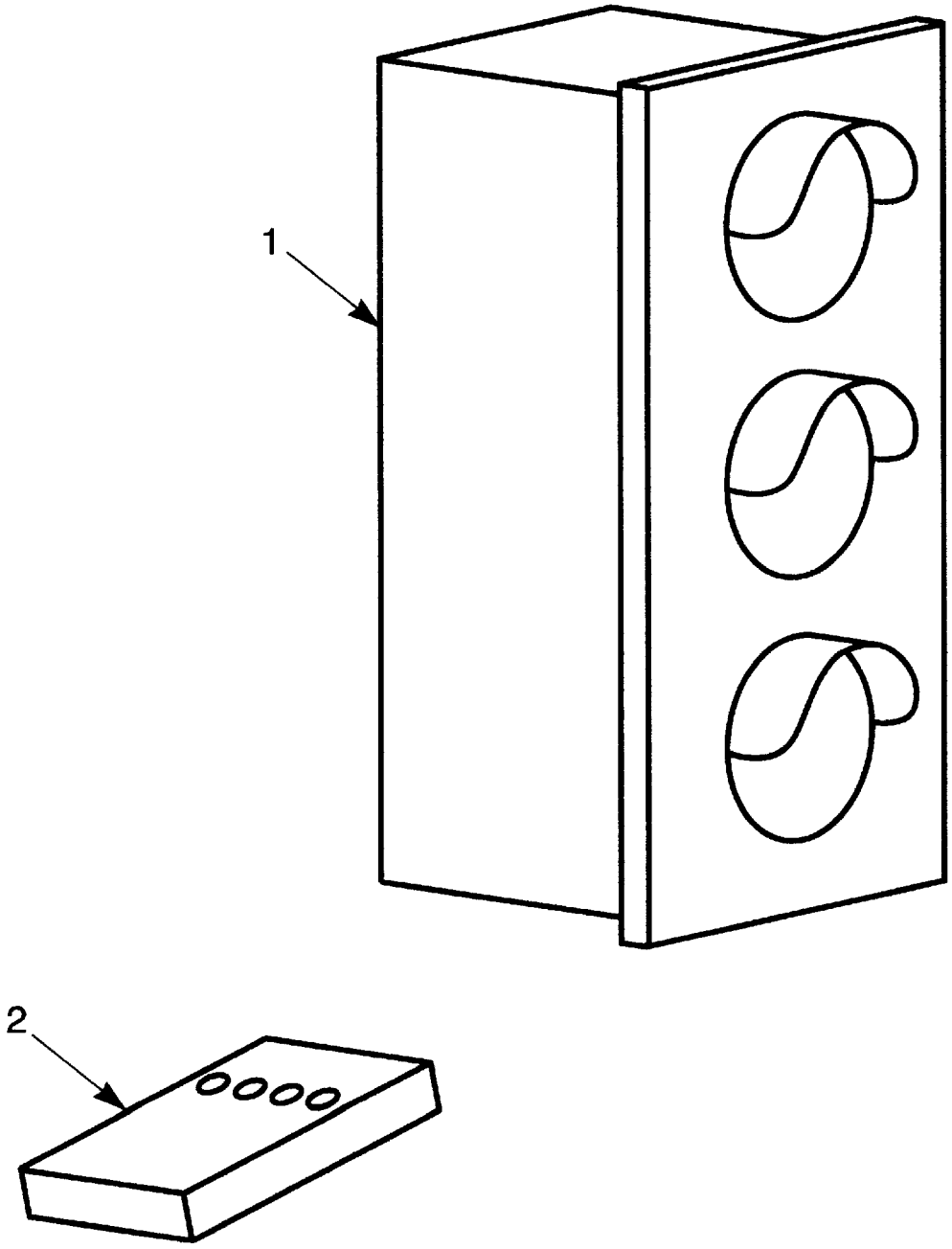
FIG. 1 is a perspective view of the classroom signalling device and hand-held remote control, of the present invention.

FIG. 1 illustrates a classroom signalling device 1 and hand-held remote control 2. Signalling device 1 is provided with a housing supporting a plurality of visual indicators and in a preferred embodiment utilizes three lamps of different colors, (e.g., red, yellow and green), mounted in the housing. Although it is contemplated the arrangement of the signalling lamps could be in a variety of configurations, a preferred embodiment places them in a conventional vertical arrangement, as depicted in FIG. 1. The operation of the vertically arranged signalling lamps may be controlled by hand-held remote control 2.

Figure 2:
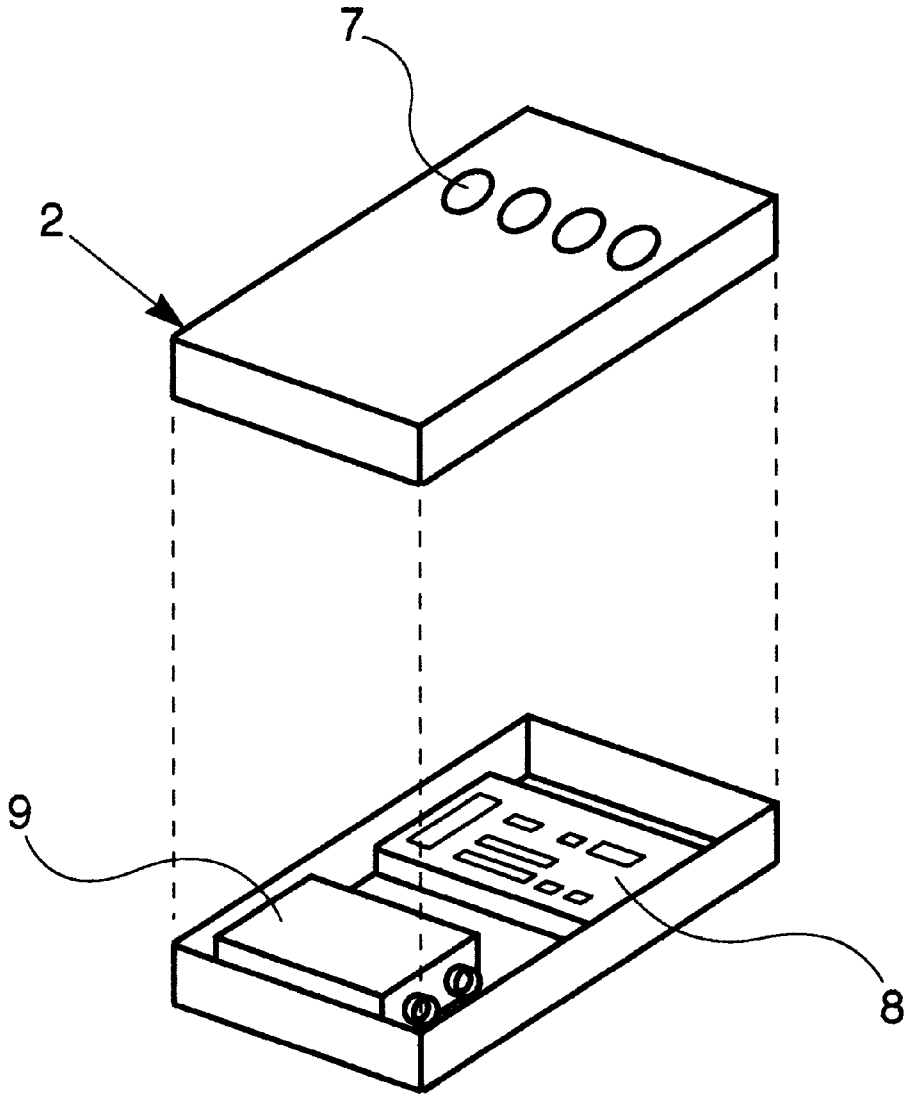
FIG. 2 is an exploded view of the hand-held remote control from FIG. 1.

FIG. 2 is an exploded view of the hand-held remote control from FIG. 1. Hand-held remote control 2 may be comprised of a hand-held housing supporting lamp signalling control buttons 7, which operate signalling control transmitter 8, powered by battery 9. Although a variety of transmission mediums are contemplated, a preferred embodiment employs an infrared signal in communication with classroom signalling device 1.

Figure 3:
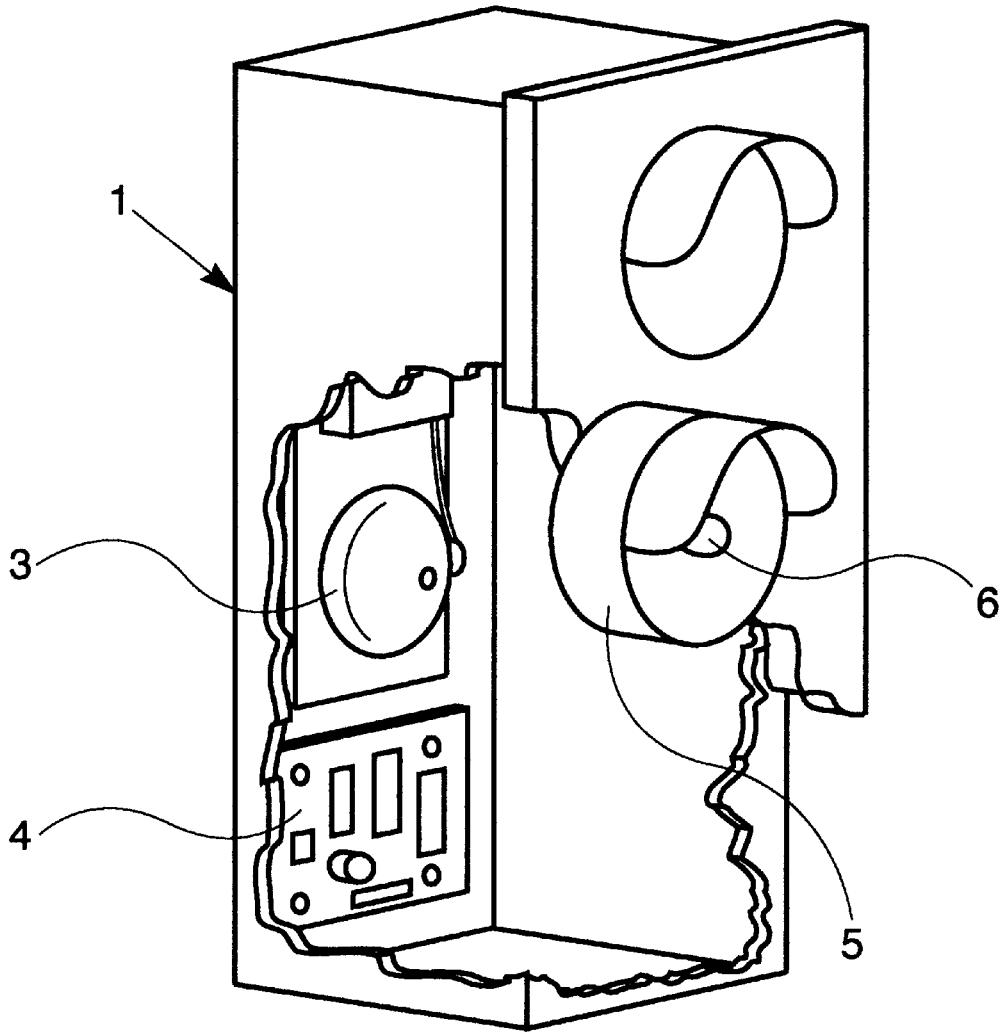
FIG. 3 is a partially exposed interior view of the classroom signalling device of FIG. 1.

FIG. 3 is a partially exposed interior view of the classroom signalling device of FIG. 1. Signalling device 1 receives control signals from hand-held remote control 2, at signalling receiver board 4. In a preferred embodiment, receiver board 4 receives an infrared control signal from remote control 2 and outputs appropriate control signals to either audio device 3, here depicted as an electrically operated bell, and or visual indicators, here depicted as lamps 6 placed in lamp housing 5.

Figure 4:
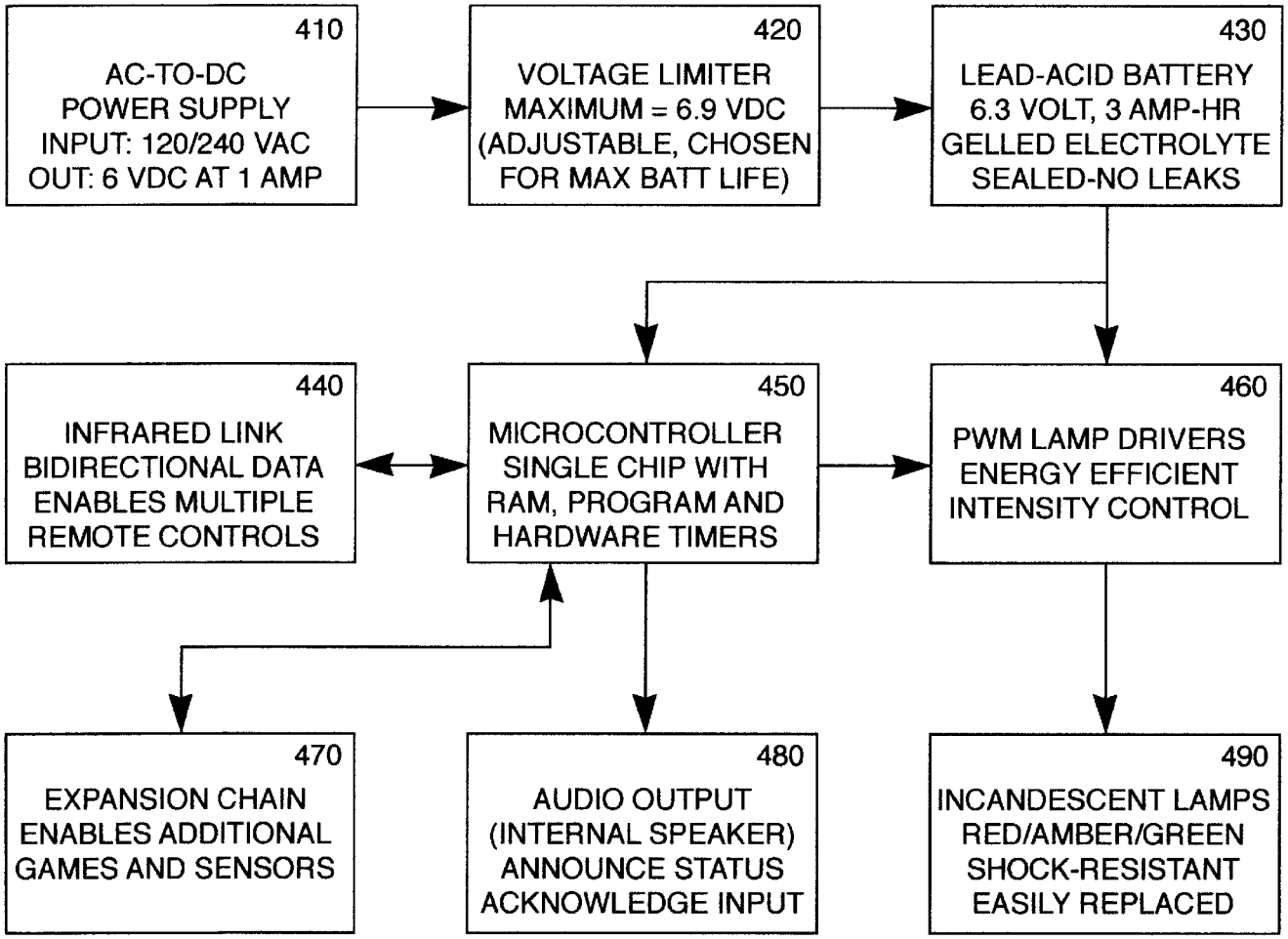
FIG. 4 is a block diagram illustrating operational components of the classroom signalling device of the present invention.

FIG. 4 is a block diagram illustrating operational components of the classroom signalling device of the present invention. Blocks 410–430 illustrate a specific embodiment for a means of providing power to lamp drivers 460. In the illustrated embodiment, an A.C. to D.C. power supply 410 is employed providing a six volt D.C. output, at one ampere, from a 120/240 voltage A.C. input. Such a power supply may be provided, for example, by a so-called wall-pack transformer or the like.

Voltage limiter 420, coupled to A.C. to D.C. power supply 410, limits supply voltage to battery 430 to a maximum of 6.9 volts. Battery 430 is illustrated in this embodiment as a 6.3 volt 3 ampere lead-acid battery. However, other battery types (e.g., Ni—Cad, Lithium, or the like) and power supply configurations are contemplated within the spirit and scope of the present invention, depending on the requirements of lamps 490, and audio components 480. Moreover, an embodiment may be provided without a battery, relying instead on a power supply alone.

Infrared link 440 may be provided to received infrared control signals from a remote control device. Such infrared remote control devices are well-known in the prior art for use in controlling televisions, VCRs, stereo equipment and the like. Signals from infrared link 440 may be transferred to microcontroller 450. In an alternative embodiment, infrared link 440 may be substituted with an RF receiver for receiving radio signals.

Microcontroller 450, receives control signals from remote control infrared link 440. It is contemplated within the spirit and scope of the present invention, that microcontroller 450 may also receive control signals from additional input devices, games, or sensors 470. Microcontroller 450 may comprise, for example, an Intel® 850-series family of processors or the like. In the preferred embodiment, for prototyping and initial production purposes, a microprocessor programmed in BASIC may be used.

Such a microprocessor may allow the apparatus to be programmed in a number of ways which will be discussed in more detail below. In addition, programmability permits different functionalities to be performed with the same device. Thus, for example, the apparatus may be used as a simple remote controlled light (red, yellow, and green lights activated in response to a remote control) or may be programmed to play games or automatically illuminate different lights in response to other indicia (e.g., noise levels or the like).

Pulse width modulated lamp driver 460 is coupled to microcontroller 450 and battery 430 to provides energy efficient intensity control to lamps 490, in response to control signals received from microcontroller 450, which is also powered by battery 430. The use of a pulse width modulated lamp driver 460 conserves power, allowing the device to be used for extended periods on battery power alone. In addition, pulse width modulated lamp driver 460 allows individual lamps to be dimmed or flashed, thus allowing for various special effects. For example, a lamp could be flashed to get class attention.

Block 470 may represent a plug-in or additional cartridge or add-on circuit board. Such add-on elements may include, for example, a memory cartridge (e.g. RAM, ROM, EEPROM, or the like) for programming microcontroller 450 to perform different functions, play games or the like). In addition, such add-ons may include a microphone or noise sensor for monitoring classroom noise levels, whereby lamps 490 would be activated in response to excessive noise by students, or motion.

Such a noise level monitoring system is disclosed, for example in Groff, U.S. Pat. No. 4,654,642, incorporated above by reference. Groff discloses an audio noise alarm, with indicators, for classrooms. Noise levels are monitored and an alarm circuitry activated when a predetermined noise level is reached. If a second noise level above the first incident occurs, an alarm may be triggered. The alarm triggering mechanism of Groff may be incorporated into an add-on device such as element 470 of FIG. 4, or may be alternately built-in. In response to triggering of a noise threshold level or levels, one or more lights 490 may be activated or tones played through audio output 480.

Audio output 480 may comprise a speaker or buzzer or other audio transducer (e.g., electric bell) which would fulfill the purpose of input acknowledgement and additional classroom feedback reinforcement. Audio output 480 may generate a number of tones which may be programmed from microprocessor 450 or may be used to reproduce sounds, music, voices, or the like.

Lamps 490 may comprise red, yellow, and green lamps 490. Lamps 490 may comprise incandescent lamps which provide sufficient intensity to be seen throughout the classroom. In the alternative, LEDs or a grouping of LEDs may be used in the place of incandescent lamps. In the preferred embodiment, red, yellow, and green lamps may be used to emulate a stop light. However, other colors or other numbers of lamps may be used without departing from the spirit and scope of the present invention.

The block diagram of FIG. 4 is for illustrative purposes only. The apparatus of the present invention may be constructed using other hardware. For example, a simpler system may be constructed without the need for a microprocessor controller, or may be constructed using a programmable logic array (PLA) or the like. Schematics of the preferred embodiment contemplated at the time of filing are provided in the Appendix attached herewith.

The apparatus of the present invention may be utilized in a method of teaching and classroom instruction as follows. The apparatus of the present invention may be sold under the trademark MR. LIGHT™. MR. LIGHT™ was first conceived in the classroom based upon 35 years of classroom teaching experience of the inventor. MR. LIGHT™ was born out of a personal desire for a tool to help with classroom management to eliminate the necessity of giving verbal commands for each routine activity. Originally intended for classroom use to aid in the teaching of elementary school pupils, over time, many other uses have been discovered for MR. LIGHT™.

MR LIGHT™ is a unique interactive classroom management system shaped in the universally recognized symbol of a traffic light. MR. LIGHT™ also includes a hand-held controller similar to a television remote. The hand-held controller may be used in a number of ways. In a primary embodiment, such a controller may be used to simply activate the red, yellow, and green lights of MR. LIGHT™ either by pressing a correspondingly colored button on the remote, or by pressing a single button a number of times in succession (e.g., once, twice, or three times).

Being remote controlled, MR. LIGHT™ may have several options as to light sequences or bell tones. In addition, MR. LIGHT™ may be programmed (via cartridge 470, for example) to accept simple musical tunes to add to the tones. Moreover, music, voices, or sounds may be recorded using a microphone attached to or provided as part of, MR LIGHT™ or the MR. LIGHT™ remote control for later playback as part of the learning program. The bell tones or sounds accompanying commands (as well as the lighting sequence) may also be changed by setting switches or jumpers within MR. LIGHT™.

With the use of power supply 410, MR. LIGHT™ may be operated plugged into a wall outlet. Alternatively, MR. LIGHT™ may operate on battery power for up to four hours (in the present embodiment). The use of batteries allows MR. LIGHT™ to be portable, allowing the device to moved about the classroom without entangling wires. Portability also allows MR. LIGHT™ to be used outside the classroom, for example, on school buses, field trips, and during recess.

On MR. LIGHT™ remote control 2, there may be provided a set of buttons 2 to activate desired light and bell (or sound) combinations. MR. LIGHT™ will respond to commands issued by remote control 2 at distances of up to seventy-five feet, allowing it to be used from any location in any normal sized classroom.

The original application for MR. LIGHT™ was for issuing instructions for classroom cleanup and dismissal without having to verbally instruct students to start such assigned tasks every day. MR. LIGHT™ may be set in green mode for the start of class. When class time is short, (e.g., five minutes until dismissal), MR. LIGHT™ may be switched to yellow or red. This color change indicates to students that it is time to stop work and begin to clean up.

MR. LIGHT™ may then be switched to (or remain at) yellow until the teacher decides that cleanup is complete, all students are behaved and ready for next class. Alternatively, microprocessor 450 may be provided with an internal clock to time light changes at the beginning and ending periods of each class. Such a clock may be set using an LCD or LED display (not shown) which may be provided as a plug-in element 470.

Alternatively, such a clock may be set using flashing sequences of lights to set present time, and the start and stop times for each class. A combination of internal clock and manual override may be used. For example, the internal clock may initially switch MR. LIGHT™ to red or yellow at a time five minutes before end of class. However, resetting MR. LIGHT™ to green may be performed manually by a teacher.

Similarly, MR. LIGHT™, using add-on modules, may be used to monitor classroom behavior automatically. For example, a motion sensor provided in a module 470 (such as an infrared motion sensor known in the alarm arts) may be used to detect motion, while a microphone also provided in a module 470, (or even within remote control 2) may be used to measure classroom sound activity. Only when all students are quiet, will MR. LIGHT™ switch to green and a tone, music, or sound be activated, indicating class is over.

The use of MR. LIGHT™ alleviates the teacher of the need to remind students of their duty to clean up and prepare for the end of a class. As a result, the teacher is no longer perceived as taskmaster. So long as MR. LIGHT™ is visible or audible, the students have direction.

MR. LIGHT™ is also ideally suited for blind, deaf, or other students with special needs. For example, the red, yellow, and green lights of MR. LIGHT™ are readily seen and understood by deaf students. When hearing-impaired students are mainstreamed into regular schools, disruptions may occur due to the noise levels created (unintentionally) by hearing-impaired students. MR. LIGHT™ can help deaf students monitor their noise levels so as not to disturb other classes.

Other specific applications and gaming uses for MR. LIGHT™ are known. As a teaching tool, the remote control for MR. LIGHT™ may given to a particular student or students during class as a reward for good behavior (or in turns). The use of the control is empowering to the student and also teaches responsibility to students.

Two to five minutes prior to recess, lunch, or at the end of the day, a selected student may retrieve the remote control. Upon depressing a red button, an activated red lamp and ringing bell (or tone) indicates to the class to be still and silent. Upon activation of the yellow light, again with ringing bell (or tone), the students prepare for dismissal and await activation of the green light. The class monitor operating MR. LIGHT™ then, selectively dismiss the class by rows whereby well behaved rows are green lighted and dismissed, and poorly behaved rows of students are red lighted to remain behind. The effect of using MR. LIGHT™ is that the students compete to be orderly and well behaved.

Another classroom application for MR. LIGHT™ is in games. For example, an article in the room might be chosen as the correct answer, and questions asked of the MR. LIGHT™ monitor. A red signal indicates the class guess as wrong ("cold"), a yellow light as warm, and green as correct. The correct guesser may then be assigned the role of MR. LIGHT™ monitor.

The class game "Avalanche" has the students disperse to the four corners of the classroom when MR. LIGHTS™'s green light is activated. Yellow warns the students to be in a corner, followed by red whereby a corner is randomly selected by a designated student (with eyes closed). Those students in the selected corner are now "out," and the process is repeated until only two students remain, who now become the new MR. LIGHT™ monitor-controller and corner guesser.

College bowl questions and answers are another game area application for MR. LIGHT™ with each team provided with a MR. LIGHT™ remote control. Questions may be asked of students, and each team may press a corresponding team color button (red, green, yellow) to answer. A timing circuit within the microcontroller 450 of Mr. Light may be programmed to light only the corresponding light for the team responding first. Alternatively, each team may be given a remote control generating different infrared signals such that Mr. Light™ may indicate, via audio signals, which team has responded first.

Other applications for MR. LIGHT™ are also possible. As MR. LIGHT™ may be provided with a speaker, an audio microphone incorporated into the infrared remote control (and communicating via infrared or RF link) may be used for Public Address (PA) over MR. LIGHT™. Thus, a teacher may use MR. LIGHT™ to make announcements or the like.

MR. LIGHT™ may also be used for writing activities, journal writing, and test-taking in the classroom. With activities and writing styles, the timer in MR. LIGHT™ may be incorporated along with audio signals. A timer within MR. LIGHT™ may be preset for a determined number of minutes. When timing begins, a green light and tone signal commencement of a writing assignment. Students then write continuously until the red light flashes three times (and a tone is sounded) signally the time for writing has finished. Prior to the end of the writing period, the yellow light may be lit and another tone sounded to let students know that the writing period is about to end.

For a variety of reasons, students respond to being timed by feeling more "on-task" and compelled to make wise use of limited time. Most all students respond well to the timed task.

Sustained silent reading is a common daily practice in the field of education. A student monitor may be selected to set the timer on MR. LIGHT™ and then activate the green light and signal tone. The time period may vary from fifteen to thirty minutes depending upon grade level. Again, classes respond well to being timed.

Timed activities abound in test taking, partner talk, group discussions, and other related activities. With the time use, there is more active participation among the students as it provides a sense of urgency to make good use of the time allotted. In addition, each student is well aware than each will have the responsibility and fun of setting the timer and activating the green light and bell.

Timed activities also help teachers make effective use of classroom time as well. When a particular classroom activity becomes delayed or bogged down by unnecessary distraction or discussion, other, later classroom activities are short-changed as a result. MR. LIGHT™ helps a teacher to properly budget time for each activity during the day, insuring that activities at the end of the day are not short-changed due to time run-over from activities early in the day. Thus, Mr. LIGHT™ enforces time discipline on both teacher and student.

School assembly use of MR. LIGHT™ is also very effective. When classes enter the media center or auditorium, a chosen student or teacher monitor may activate the yellow light of MR. LIGHT™. MR. LIGHT™ may be hung high on the stage or at another prominent location where it will be seen by all participants. As each class enters, they are aware they are expected to enter in a quiet and orderly manner. After all classes are seated and quiet, the monitor signifies the beginning of the assembly by activating the green light and signal tone. The green light may remain lit during the assembly.

During the assembly, the yellow light may be activated if the monitor believes that the students are being noisy or restless. Alternatively, a sound detector or motion sensor may detect excessive unruliness and activate the yellow or red light (and/or sound a warning tone). If provided with a microphone, MR. LIGHT™ may be used as a public-address system during such an assembly.

At the end of the assembly, the yellow light may be activated to signal classes to exit. It has been demonstrated that two to three hundred students will be quite cooperative in this situation. No one class wants to be "red lighted" for noisy or unruly exit and be forced to return to their seats. MR. LIGHT™ is thus a very effective tool in these large group situations.

While the preferred embodiment and various alternative embodiments of the invention have been disclosed and described in detail herein, it may be apparent to those skilled in the art that various changes in form and detail may be made therein without departing from the spirit and scope thereof.

I claim:

1. A method of teaching, comprising the steps of:

providing, in a housing visible to students in a classroom, red, yellow, and green lights controlled by a control device;

providing, in a remote control, at least one control device for controlling activation of the red, yellow, and green lights in the housing;

activating, prior to the end of an instruction period, the red light to indicate students an instruction period is about to end;

activating, after activation of the red light, the yellow light, to indicate to students that preparations for termination of the instruction period should commence; and activating the green light when the students have completed preparations for termination of the instruction period to indicate to the students that the instruction period has ended.

2. The method of teaching of claim 1, wherein said step of activating, prior to the end of an instruction period, the red light to indicate students an instruction period is about to end comprises the step of activating, with an internal timer, the red light for a predetermined period at a predetermined programmed time prior to the end of the instruction period.

3. The method of teaching of claim 2, wherein said step of activating, prior to the end of an instruction period, the red light to indicate students an instruction period is about to end further comprises the step of generating a warning tone in conjunction with activation of the red light.

4. The method of teaching of claim 2, wherein said step of activating, after activation of the red light, the yellow light, to indicate to students that preparations for termination of the instruction period should commence comprises the step of activating, with the internal timer, the yellow light after activation of the red light for a predetermined period.

5. The method of teaching of claim 1, wherein said step of activating the green light when the students have completed preparations for termination of the instruction period to indicate to the students that the instruction period has ended comprises the step of activating, with the remote control, the green light when students have completed preparations for termination of the instruction period.

6. The method of teaching of claim 1, further comprising the steps of:

monitoring student noise levels using a monitoring means provided within the housing; and activating the yellow light when noise levels exceed a first predetermined threshold.

7. The method of teaching of claim 6, further comprising the step of:

activating a first warning tone when noise levels exceed the first predetermined threshold.

8. The method of teaching of claim 6, further comprising the steps of:

activating the red light when noise levels exceed a second predetermined threshold higher than the first predetermined threshold.

9. The method of teaching of claim 8, further comprising the step of:

activating a second warning tone when noise levels exceed the second predetermined threshold.

10. A teaching apparatus comprising:

a housing resembling a traffic signal;

a red light, a yellow light, and a green light, arranged in the housing so as to resemble red, yellow, and green lights of a traffic signal;

a power supply for providing power to the red light, the yellow light, and the green light; and a remote control for remotely activating the red light, the yellow light, and the green light.

11. The apparatus of claim 10, further comprising:

a timing means, coupled to at least one of the red light, the yellow light, and the green light, for activating a selected one of the red light, the yellow light, and the green light, at a predetermined time.

12. The apparatus of claim 11, wherein said timing means activates said red light at a predetermined programmed time prior to the termination of an instruction period.

13. The apparatus of claim 12, further comprising a tone generating means, for generating at least one tone, wherein said tone generating means generates a first warning tone when said red light is activated.

14. The apparatus of claim 12, wherein said timing means deactivates said red light after a second predetermined programmed period and activates said yellow light.

15. The apparatus of claim 14, further comprising a tone generating means, for generating at least one tone, wherein said tone generating means generates a second warning tone when said yellow light is activated.

16. The apparatus of claim 10, further comprising:

sound level monitoring means, provided in said housing and coupled to said power supply, said red light, said yellow light, and said green light, for monitoring a level of student noise and for activating said yellow light when the student noise exceeds a first predetermined threshold.

17. The apparatus of claim 16, further comprising a tone generating means, for generating at least one tone, wherein said tone generating means generates a first warning tone the student noise exceeds a first predetermined threshold.

18. The apparatus of claim 16, wherein said sound level monitoring means activates said red light when the student noise exceeds a second predetermined threshold.

19. The apparatus of claim 18, further comprising a tone generating means, for generating at least one tone, wherein said tone generating means generates a second warning tone the student noise exceeds a second predetermined threshold.

20. A teaching apparatus comprising:

a housing resembling a traffic signal;

a red light, a yellow light, and a green light, arranged in the housing so as to resemble red, yellow, and green lights of a traffic signal;

a power supply for providing power to the red light, the yellow light, and the green light; and sound level monitoring means, provided in said housing and coupled to said power supply, said red light, said yellow light, and said green light, for monitoring a level of student noise and for activating said yellow light when the student noise exceeds a first predetermined threshold.

21. A method of teaching, comprising the steps of:

providing, in a housing visible to students in a classroom, a plurality of differently colored lights controlled by a control device;

providing, in a remote control, at least one control device for controlling activation of the plurality of differently colored lights in the housing;

activating, prior to the end of an instruction period, a first one of the plurality of differently colored lights to indicate students an instruction period is about to end;

activating, after activation of the first one of the plurality of differently colored lights, a second one of the plurality of differently colored lights, to indicate to students that preparations for termination of the instruction period should commence; and activating a third one of the plurality of differently colored lights when the students have completed preparations for termination of the instruction period to indicate to the students that the instruction period has ended.

22. The method of teaching of claim 21, wherein said step of activating, prior to the end of an instruction period, the first one of the plurality of differently colored lights to indicate students an instruction period is about to end comprises the step of activating, with an internal timer, the first one of the plurality of differently colored lights for a predetermined period at a predetermined programmed time prior to the end of the instruction period.

23. The method of teaching of claim 22, wherein said step of activating, prior to the end of an instruction period, the first one of the plurality of differently colored lights to indicate students an instruction period is about to end further comprises the step of generating a warning tone in conjunction with activation of the first one of the plurality of differently colored lights.

24. The method of teaching of claim 22, wherein said step of activating, after activation of the first one of the plurality of differently colored lights, the second one of the plurality of differently colored lights, to indicate to students that preparations for termination of the instruction period should commence comprises the step of activating, with the internal timer, the second one of the plurality of differently colored lights after activation of the first one of the plurality of differently colored lights for a predetermined period.

25. The method of teaching of claim 21, wherein said step of activating the third one of the plurality of differently colored lights when the students have completed preparations for termination of the instruction period to indicate to the students that the instruction period has ended comprises the step of activating, with the remote control, the third one of the plurality of differently colored lights when students have completed preparations for termination of the instruction period.

26. The method of teaching of claim 21, further comprising the steps of:

monitoring student noise levels using a monitoring means provided within the housing; and activating the second one of the plurality of differently colored lights when noise levels exceed a first predetermined threshold.

27. The method of teaching of claim 26, further comprising the step of:

activating a first warning tone when noise levels exceed the first predetermined threshold.

28. The method of teaching of claim 26, further comprising the steps of:

activating the first one of the plurality of differently colored lights when noise levels exceed a second predetermined threshold higher than the first predetermined threshold.

29. The method of teaching of claim 28, further comprising the step of:

activating a second warning tone when noise levels exceed the second predetermined threshold.

30. A teaching apparatus comprising:

a housing resembling a traffic signal;

a plurality of differently colored lights arranged in the housing so as to resemble a plurality of differently colored lights of a traffic signal;

a power supply for providing power to the plurality of differently colored lights; and a remote control for remotely activating each of the plurality of differently colored lights.

31. The apparatus of claim 30, further comprising:

a timing means, coupled to at least one of the plurality of differently colored lights, for activating a selected one of the plurality of differently colored lights, at a predetermined time.

32. The apparatus of claim 31, wherein said timing means activates the first one of the plurality of differently colored lights at a predetermined programmed time prior to the termination of an instruction period.

33. The apparatus of claim 32, further comprising a tone generating means, for generating at least one tone, wherein said tone generating means generates a first warning tone when said first one of the plurality of differently colored lights is activated.

34. The apparatus of claim 32, wherein said timing means deactivates said first one of the plurality of differently colored lights after a second predetermined programmed period and activates a second one of the plurality of differently colored lights.

35. The apparatus of claim 34, further comprising a tone generating means, for generating at least one tone, wherein said tone generating means generates a second warning tone when said second one of said plurality of differently colored lights is activated.

36. The apparatus of claim 30, further comprising:

sound level monitoring means, provided in said housing and coupled to said power supply and said plurality of differently colored lights, for monitoring a level of student noise and for activating a first one of said plurality of differently colored lights when the student noise exceeds a first predetermined threshold.

37. The apparatus of claim 36, further comprising a tone generating means, for generating at least one tone, wherein said tone generating means generates a first warning tone the student noise exceeds the first predetermined threshold.

38. The apparatus of claim 36, wherein said sound level monitoring means activates a second one of said plurality of differently colored lights when the student noise exceeds a second predetermined threshold.

39. The apparatus of claim 38, further comprising a tone generating means, for generating at least one tone, wherein said tone generating means generates a second warning tone the student noise exceeds the second predetermined threshold.

40. A teaching apparatus comprising:

a housing resembling a traffic signal;

a plurality of differently colored lights, arranged in the housing so as to resemble a traffic signal; and a power supply for providing power to said plurality of differently colored lights;

sound level monitoring means, provided in said housing and coupled to said power supply and said plurality of differently colored lights, for monitoring a level of student noise and for activating one of said plurality of differently colored lights when the student noise exceeds a first predetermined threshold.

* * * * *

UNITED STATES PATENT AND TRADEMARK OFFICE

CERTIFICATE OF CORRECTION

PATENT NO. : 6,072,395
DATED : June 6, 2000
INVENTOR(S) : Mary Ellen Vega

It is certified that error appears in the above-identified patent and that said Letters Patent is hereby corrected as shown below:

Title page,
Change Item [60], to read: -- [60] Provisional application No. 60/077,319, Mar. 9, 1998 --

Column 1,
Lines 6-9, delete the present paragraph and insert: -- The present application claims priority from Provisional U.S. Patent Application Ser. No. 60/077,319, filed on Mar. 9, 1998, and incorporated herein by reference --.

Signed and Sealed this

Fifteenth Day of October, 2002

*Attest:*

*Attesting Officer*

JAMES E. ROGAN
*Director of the United States Patent and Trademark Office*